US008635965B2

(12) United States Patent
Segato

(10) Patent No.: US 8,635,965 B2
(45) Date of Patent: Jan. 28, 2014

(54) SAIL SYSTEM

(75) Inventor: Marcello Segato, Milan (IT)

(73) Assignee: SEAGATE S.r.l., Milan (IT)

( * ) Notice: Subject to any disclaimer, the term of this patent is extended or adjusted under 35 U.S.C. 154(b) by 319 days.

(21) Appl. No.: 13/255,377

(22) PCT Filed: Mar. 5, 2010

(86) PCT No.: PCT/IB2010/000494

§ 371 (c)(1),
(2), (4) Date: Sep. 8, 2011

(87) PCT Pub. No.: WO2010/103377

PCT Pub. Date: Sep. 16, 2010

(65) Prior Publication Data

US 2012/0000410 A1 Jan. 5, 2012

(30) Foreign Application Priority Data

Mar. 9, 2009 (IT) ..... MI2009A0347

(51) Int. Cl.

| | |
|---|---|
| ***B63H 9/04*** | (2006.01) |
| ***B63H 9/08*** | (2006.01) |
| ***B63H 9/10*** | (2006.01) |
| ***B63B 15/02*** | (2006.01) |

(52) U.S. Cl.

USPC .... 114/39.21; 114/39.11; 114/91; 114/102.1; 114/102.15; 114/102.16

(58) Field of Classification Search

USPC ..... 114/39.11–39.32, 89–94, 102.1–102.3
See application file for complete search history.

(56) References Cited

U.S. PATENT DOCUMENTS

| | | | | | |
|---|---|---|---|---|---|
| 3,455,261 | A | * | 7/1969 | Perrin | 114/39.15 |
| 4,682,557 | A | * | 7/1987 | Magruder et al. | 114/39.14 |
| 4,940,008 | A | | 7/1990 | Hoyt | |
| 5,003,903 | A | * | 4/1991 | Olsen | 114/102.18 |
| 6,390,013 | B1 | | 5/2002 | Cornell | |

FOREIGN PATENT DOCUMENTS

| | | | | | |
|---|---|---|---|---|---|
| DE | 102004012760 | | | 10/2005 | |
| EP | 15875 | A1 | * | 9/1980 | B65H 9/06 |
| FR | 2535671 | | | 5/1984 | |
| FR | 2825341 | A1 | * | 12/2002 | B63H 9/08 |
| GB | 847310 | | | 9/1960 | |
| JP | 61291291 | A | * | 12/1986 | B63B 35/82 |
| WO | WO 8607328 | A1 | * | 12/1986 | B63H 9/06 |

* cited by examiner

*Primary Examiner* — Ajay Vasudeva
(74) *Attorney, Agent, or Firm* — Jacobson Holman PLLC

(57) ABSTRACT

A sail system comprising a substantially isosceles-triangle-shaped sail with two booms and an arc-shaped element. The two booms are arranged along substantially equal sides of the sail and articulated to one another with a joint that defines a vertex of the triangle. The arc-shaped element is coupled to a deck of a boat for pivoting about a transverse axis between a raised position and a lowered position on the deck. Each boom has a coupling element on the arc-shaped element, the coupling element being slidable both along the arc-shaped element and along the respective boom.

6 Claims, 10 Drawing Sheets

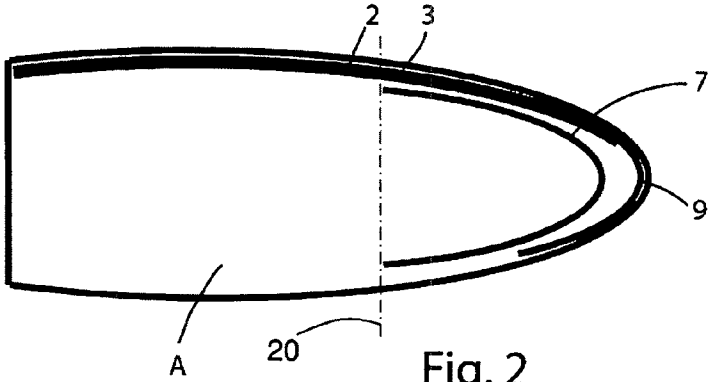
Fig. 2
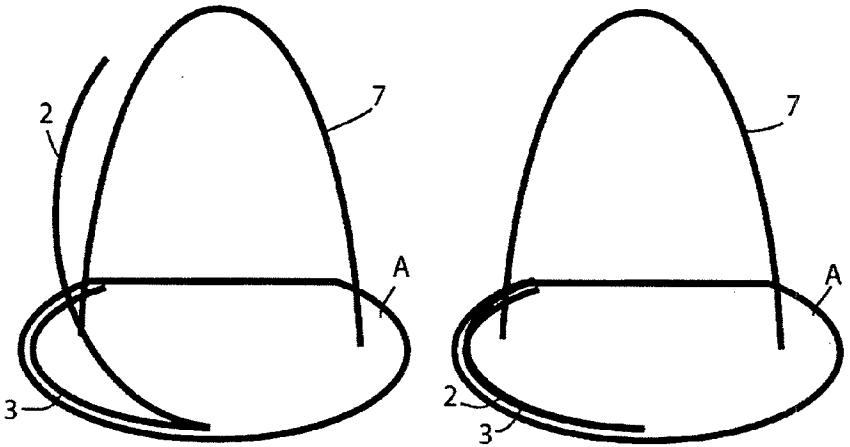
Fig. 3a
Fig. 3b
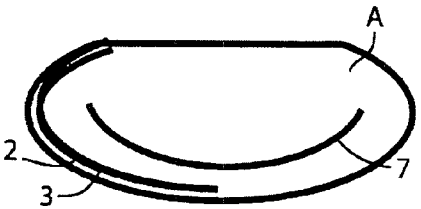
Fig. 3c

SAIL SYSTEM

This is a national stage of PCT/IB10/000494 filed Mar. 5, 2010 and published in English, which claims the priority of Italian number M12009A 000347 filed Mar. 9, 2009, hereby incorporated by reference.

The present invention consists of an improved sail system. In greater detail, the invention concerns an innovative sail system that allows to combine characteristics that are currently difficult to combine in a single boat, allowing a boat with a completely usable hull, without obstruction due to the sailing equipment, also when navigating with a motor, and able to be transformed extremely quickly into a sailing boat.

Over the last few decades different solutions have been proposed that tend towards seeking a hybrid sailing-motor boat solution that allows both modes of use of the boat itself to be exploited in an optimal manner.

Whilst known solutions have provided sufficiently usable boats, none have managed to provide the user with a solution that has been able to satisfy all of the requirements of practicality and simplicity, keeping the characteristics of motor-navigation and sailing unchanged, as well as of using the spaces inside and outside the boat.

It is in this context that the solution proposed according to the present invention finds it place, which proposes an innovative sail system, capable of allowing all of the aforementioned problems to be solved.

Moreover, the solution proposed according to the present invention can also be actuated on a boat made for navigation exclusively by sail.

Therefore, the specific object of the present invention is a sail system comprising a substantially isosceles-triangle-shaped sail, two booms, arranged along the substantially equal sides of the sail and articulated to one another at an end with a joint that defines a vertex of said triangle, and an arc-shaped element, which can be coupled to the deck of the boat on which said sail system is foreseen with the two ends pivoted around an axis transverse to the hull of the boat and that is mobile around said axis between a configuration raised from the deck and a configuration lowered onto the deck, in which each boom has a coupling element on said arc-shaped element, said coupling element being slidably mounted both along said arc-shaped element and along a section of the respective boom, and in which said sail is provided with a further coupling element to said boat on which means for adjusting the orientation of the sail itself act, said booms being lowerable onto a side of the boat and said arc-shaped element being lowerable onto the deck of the boat.

According to the invention, the further coupling element of the sail to the boat coincides with the joint of the two booms and the means for adjusting the orientation of the sail comprise a sliding element to which said joint is constrained and that is slidably mounted along a guide, arched or of another shape, intended to be arranged at the bow of the boat to which the sail system is intended to be coupled.

Again according to the invention, the further coupling element of the sail to the boat is defined by a coupling body for a sheet and that is slidably mounted along a tie rod that, when the sail is raised and open, is stretched between said two booms and the means for adjusting the orientation of the sail comprise a sheet coupled with said coupling body.

Advantageously, said tie rod is coupled with the end of said two booms opposite said joint.

According to a further aspect of the present invention, the sheet lead of said sheet is carried by a support body that is slidably mounted along a further arc-shaped element able to be coupled with the deck of the boat on which the sail system is intended to be mounted.

Preferably, according to the invention, said booms are shaped with a profile substantially corresponding to the lateral profile of the boat on which the sail system is intended to be mounted.

The object of the present invention is also a boat, commercial or pleasure, motor and/or sail, comprising a sail system as defined above.

According to the present invention, said boat also comprises a seat defined on one side of the deck for accommodating the booms lowered onto the deck or a compartment defined at at least one side of the hull for accommodating the booms lowered at the side of the boat itself.

The present invention will now be described, for illustrating but not limiting purposes, according to its preferred embodiments, with particular reference to the figures of the attached drawings, in which:

FIG. 2 is a plan view of the first embodiment of the sail system according to the invention in rest position;

Figure 1:
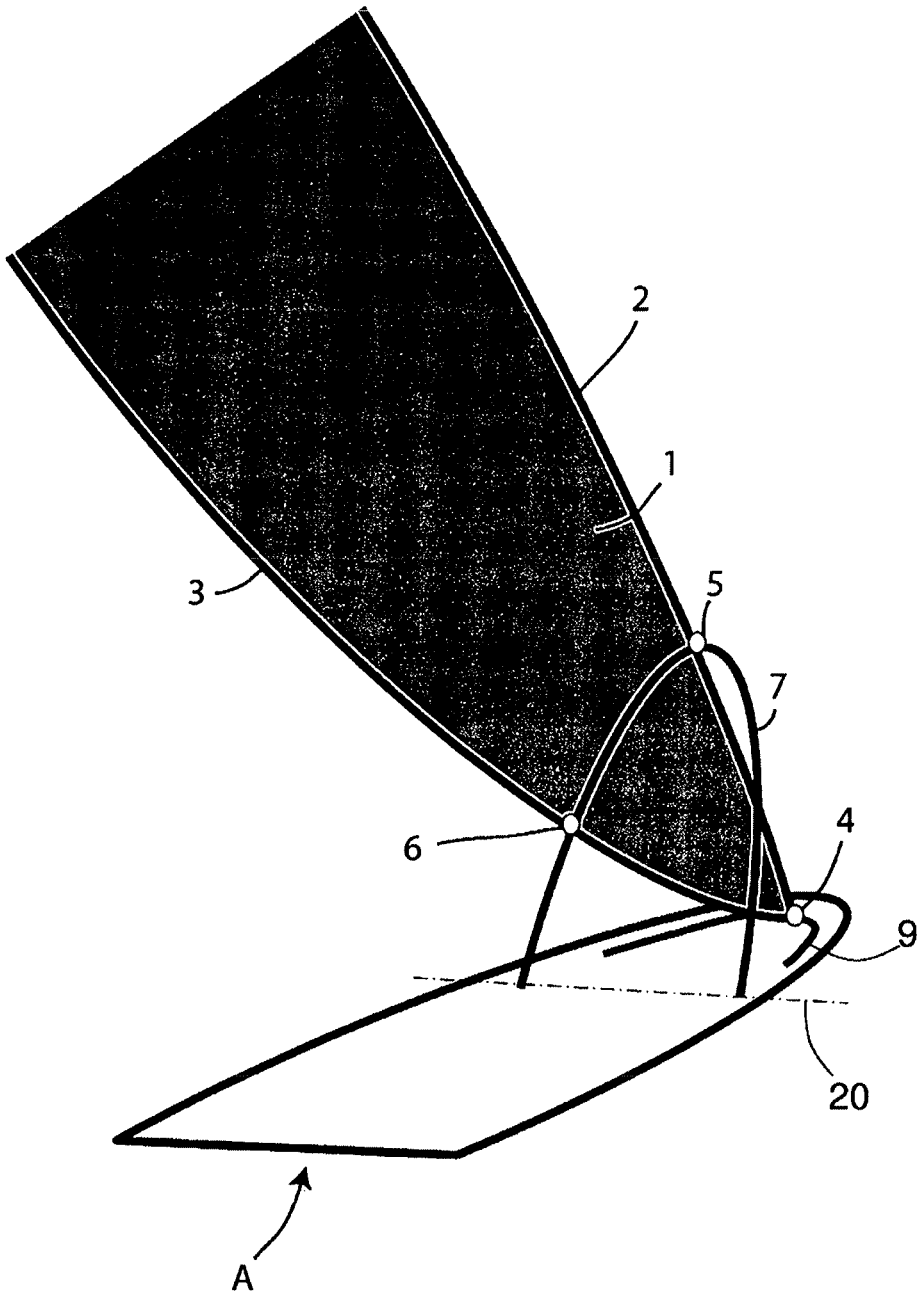
FIG. 1 is a schematic perspective view of a first embodiment of the sail system according to the invention.
Figure 4:
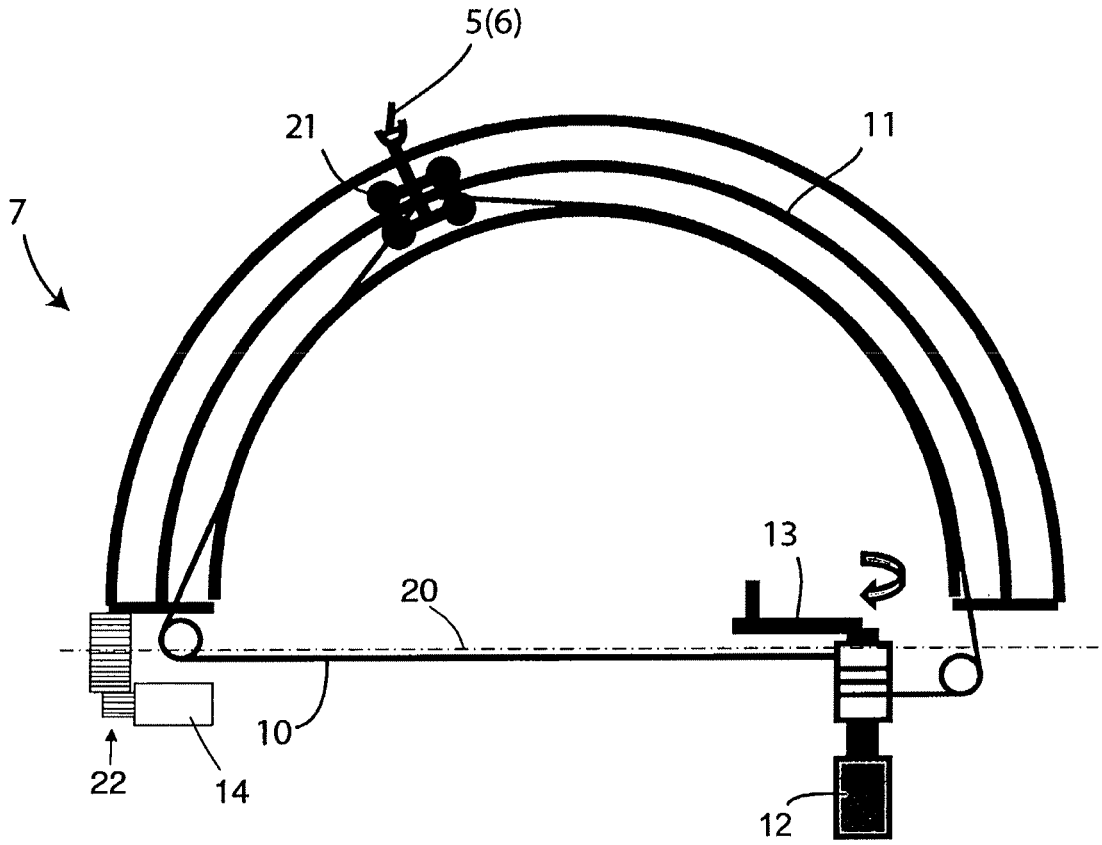
Figure 5:
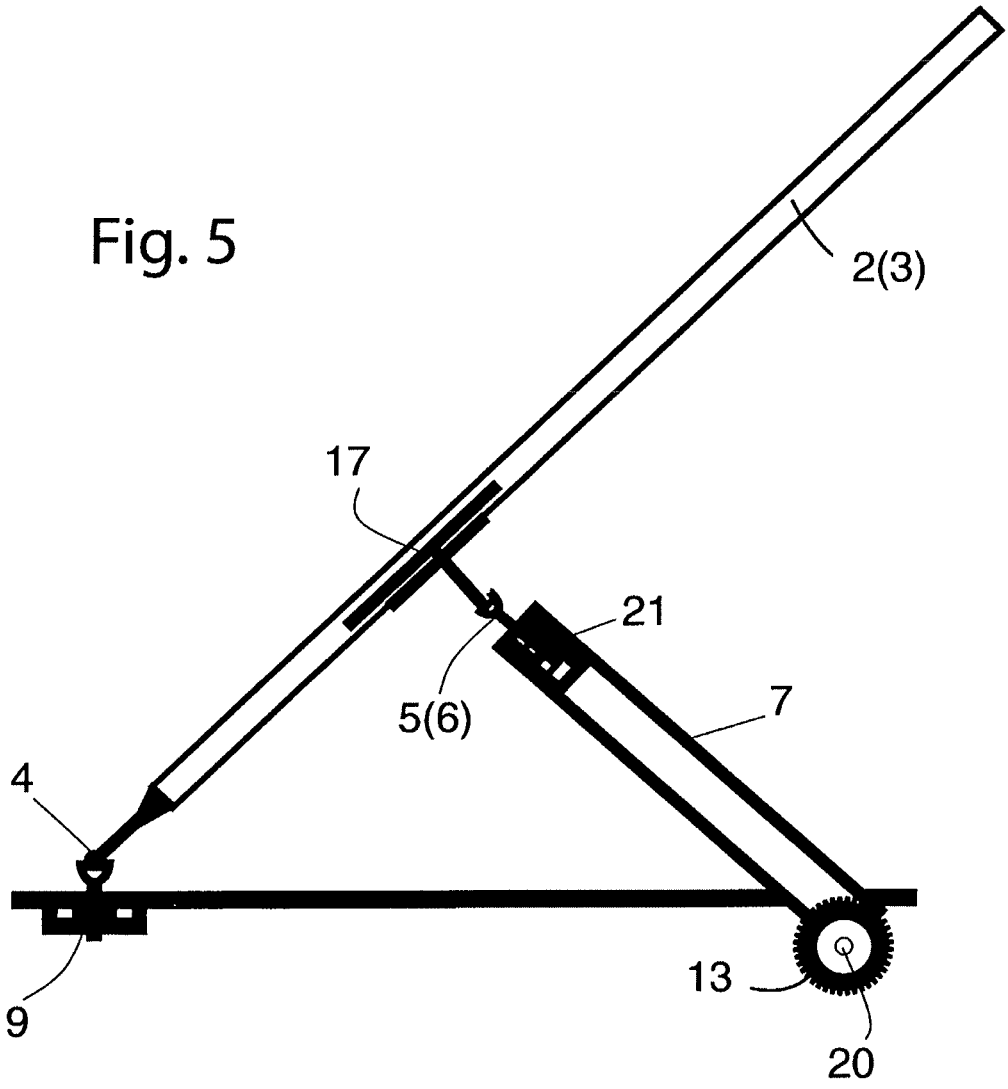
Figure 6:
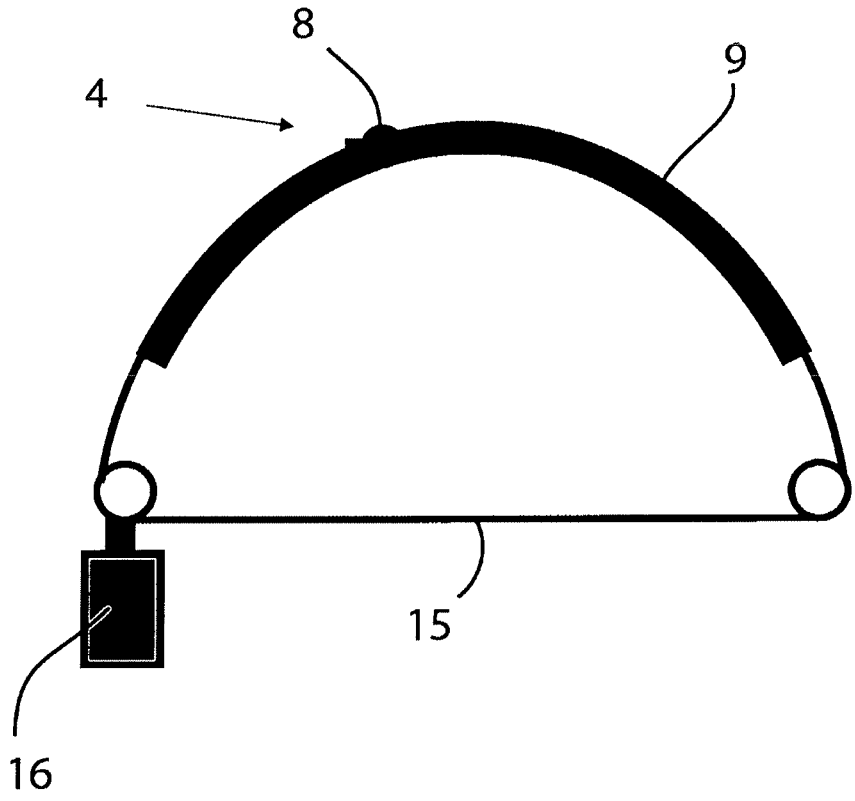
Figure 8:
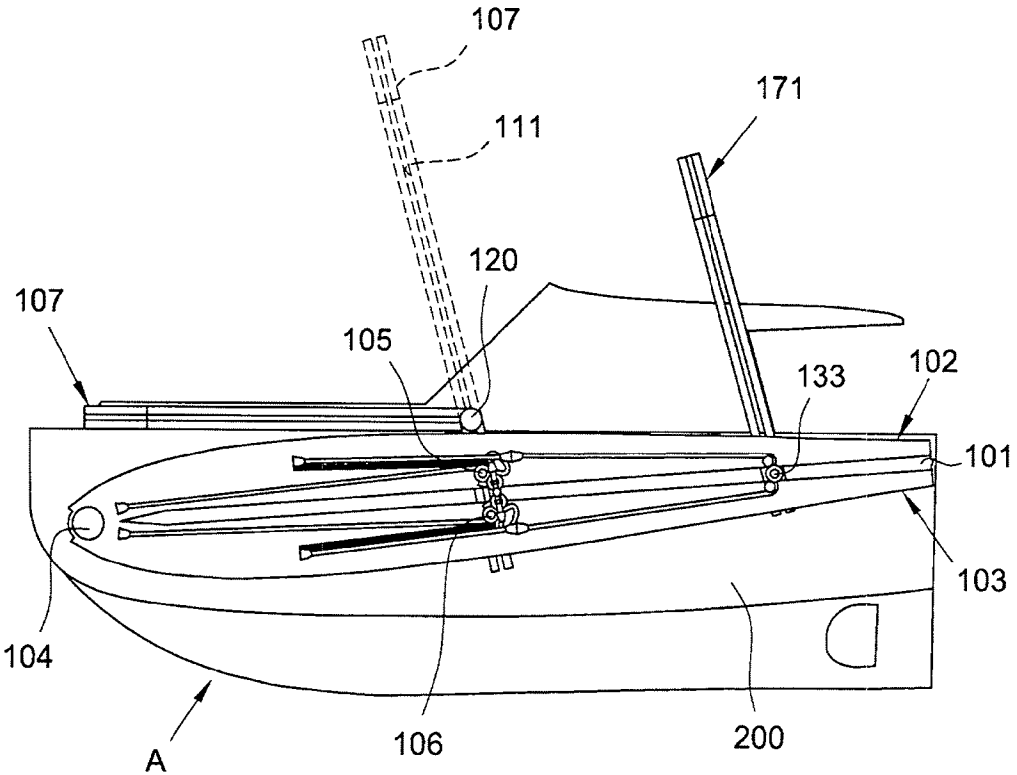
Figure 7:
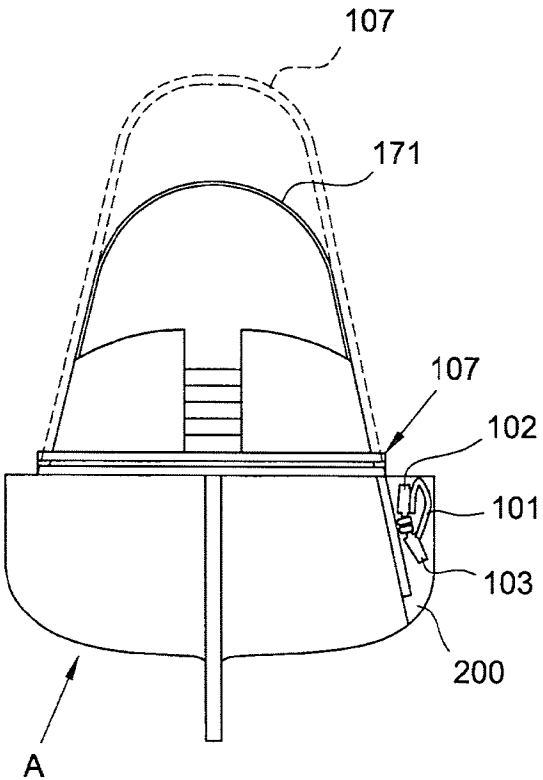
Figure 10:
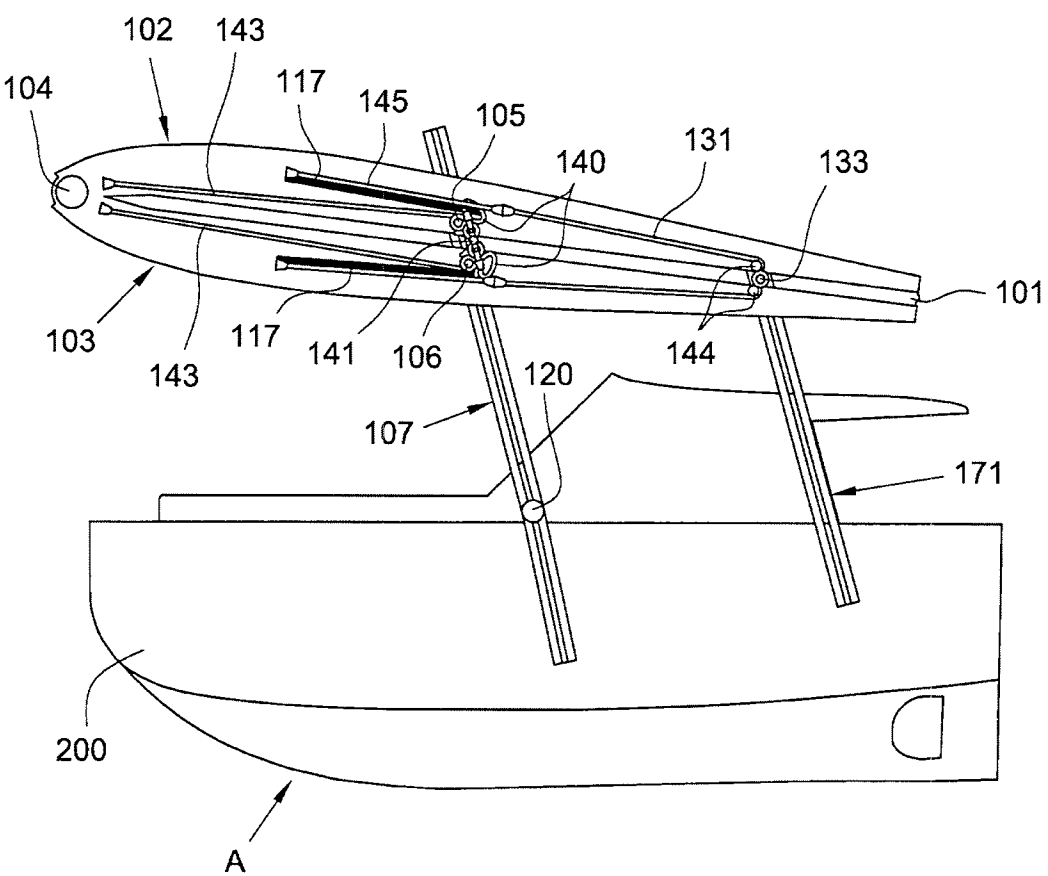
Figure 9:
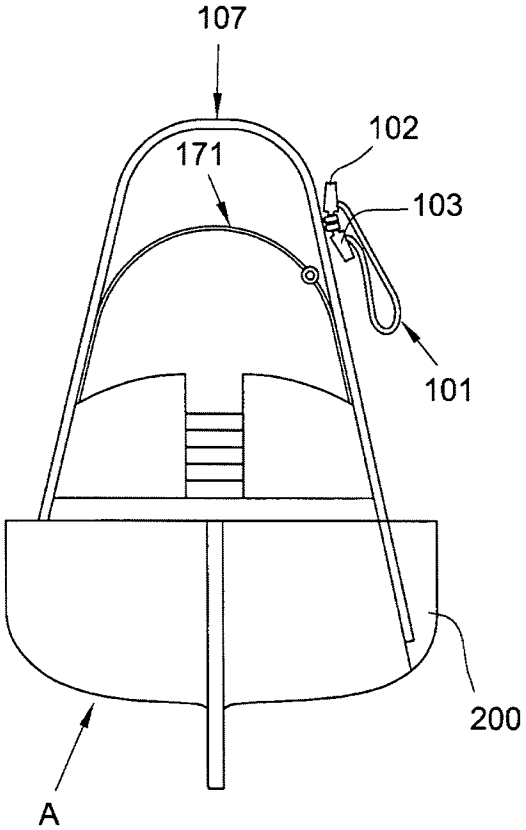
Figure 12:
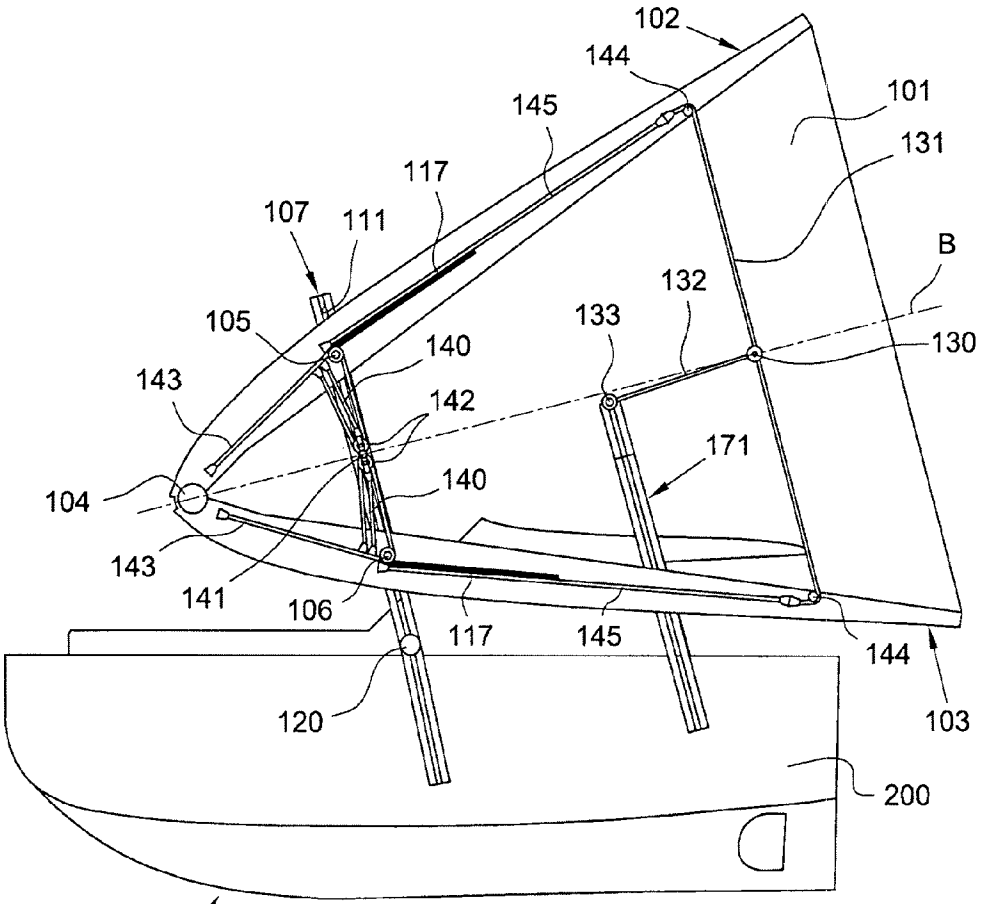
Figure 11:
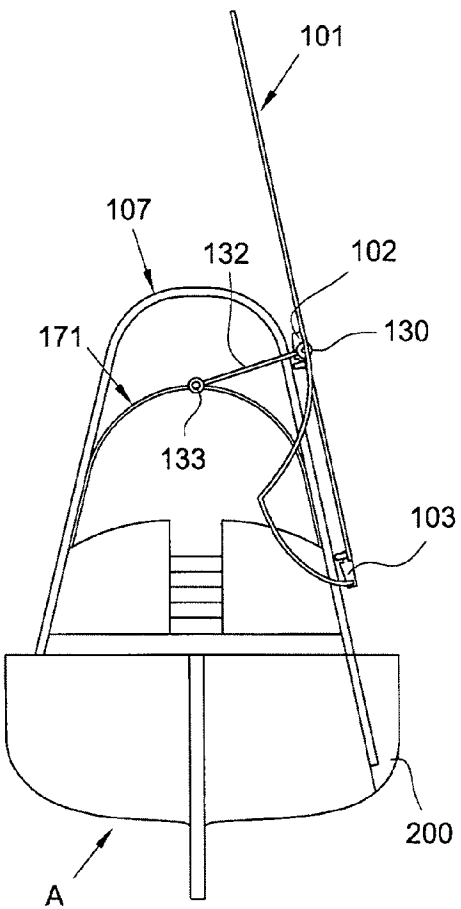
Figure 14:
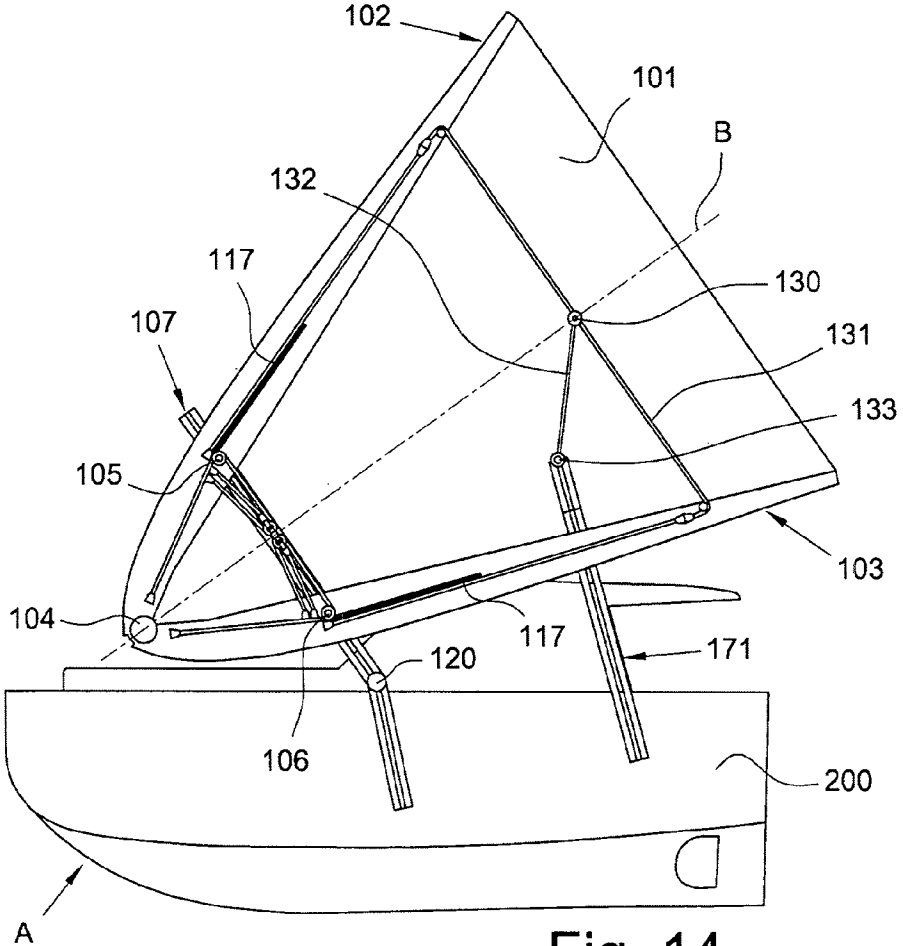
Figure 13:
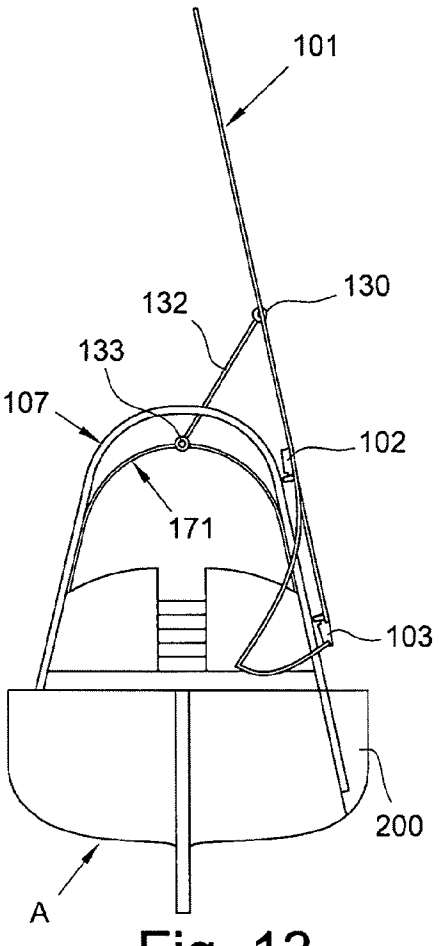
Figure 16:
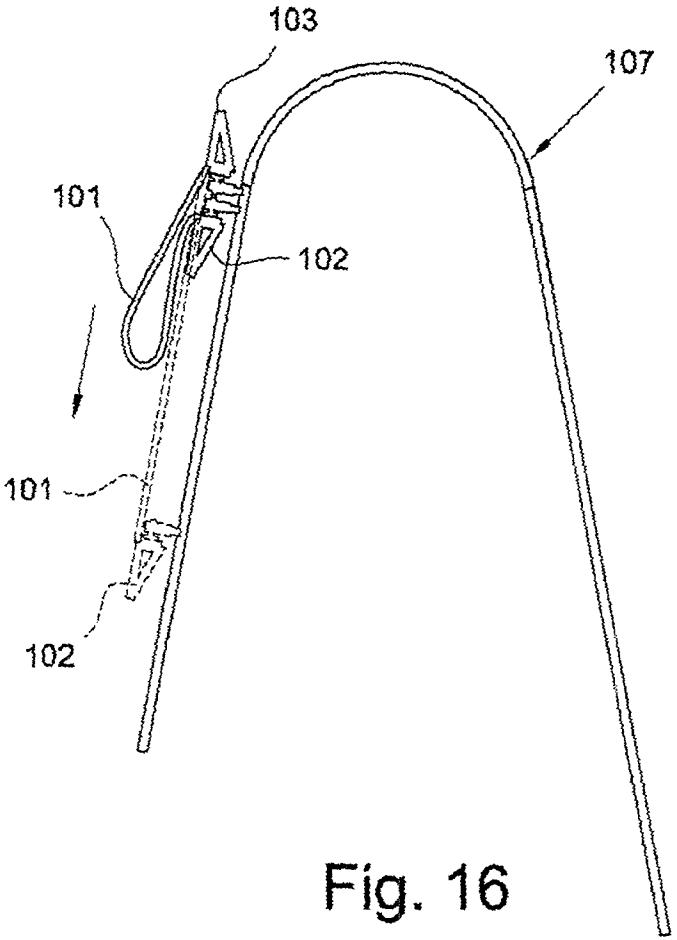
Figure 15:
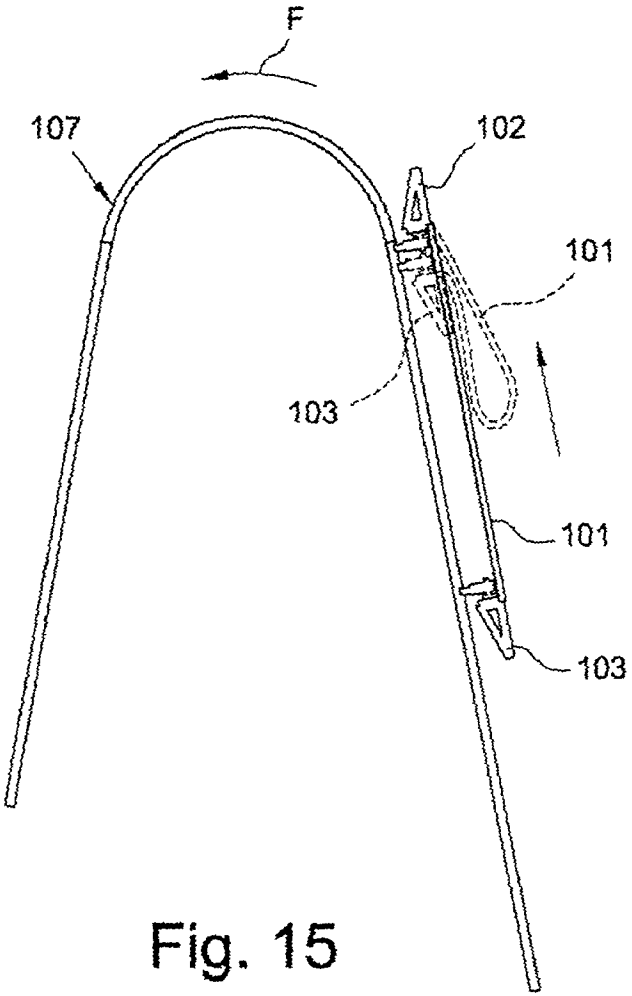

FIGS. 3*a*-3*c* show the folding steps of the first embodiment of the sail system according to the invention;

FIG. 4 schematically shows a device of the first embodiment of the sail system according to the invention;

FIG. 5 schematically shows a side view of the device of FIG. 4;

FIG. 6 schematically shows a detail of the first embodiment of the sail system according to the invention;

FIGS. 7 and 8 schematically show respective front and side views of a second embodiment of the sail system according to the present invention in closed configuration lowered at the side of the boat;

FIGS. 9 and 10 schematically show respective front and side views of the second embodiment of the sail system according to the present invention in an opening and raising step of the sail;

FIGS. 11 and 12 schematically show respective front and side views of the second embodiment of the sail system according to the present invention with the sail raised and open;

FIGS. 13 and 14 show two views like those of FIGS. 11 and 12 with the sail in a different vertical position;

FIGS. 15 and 16 schematically show the steps of turning the sail of the sail system according to the present invention.

With particular reference to FIGS. 1-6 of the attached drawings, which show a first embodiment of the sail system according to the present invention, it can be seen how such a sail system, on a boat generically indicated with reference letter A, is provided with a single isosceles triangle shaped sail 1, contained between and controlled through two booms 2, 3, that extend along the two long and equal sides of the sail 1.

Advantageously, the two booms 2, 3 have a profile that follows that of the boat A, so as to be able to be easily set on the deck or in the hull of the boat A.

The two booms 2, 3 are articulated to one another at the end facing the bow with a joint 4 that defines a vertex of the triangle or rather of the sail 1.

Each of the two booms 2, 3 has a respective coupling element or coupling point 5, 6 to an arc-shaped element 7. In the present description the expression "coupling point(s)" and the expression "coupling element(s)" will be used interchangeably to indicate the points or elements for constraining the booms and the sail to the boat.

The coupling points 5, 6 are in a substantially middle position with respect to the length of the booms 2, 3.

The coupling points 5, 6 are slidably mounted both along the arc-shaped element 7 and along a section of the respective boom 2, 3.

The sail is also provided with a further coupling element to the boat A, on which coupling element means for adjusting the orientation of the sail itself act.

In the first embodiment, such a further coupling element coincides with the joint 4 and the means for adjusting the orientation of the sail 1 comprise a sliding element 8 to which the joint 4 is constrained and that is mobile along an arched guide or rail 9 intended to be mounted at the bow of the boat A.

Both the coupling points 5, 6 of the booms 2, 3 and the constrain between the joint 4 and the sliding element 8 are equipped with suitable rotation joints that allow the maneuvers of the sail 1 to be performed.

The arc-shaped element 7 has the opposite ends pivoted around an axis 20 transverse to the hull of the boat A so as to be able to be accommodated on the deck of the boat A and be raised from it.

In order to control the sail 1, action is carried out on the position of the joint 4, which defines the further coupling element of the sail 1, i.e. of the sail system, at the bow, and the two intermediate coupling points 5, 6 of the booms 2, 3.

When, on the other hand, it is wished to eliminate the sail system, so as not to take up space on deck, i.e. to navigate by motor, the two booms 2, 3 are lowered onto a side of the boat A (FIG. 2), becoming housed inside a suitable space obtained on the deck of the hull of the boat A. In turn, the arc-shaped element 7 is lowered towards the bow, rotating around the transverse axis 20, for which reason the deck is completely free.

FIGS. 3*a*-3*c* schematically illustrate the steps of lowering the two booms 2, 3 and the arc-shaped element 7.

In the first embodiment illustrated in the attached figures, and referring in particular to FIGS. 4 and 5, the arc-shaped element 7 foresees a kinematism for the movement of the intermediate coupling point or element 5, 6 of the booms 2, 3 consisting of a cable system 10, in a closed circuit, activated through a motor system 12 and winch 13. The kinematism of a single intermediate coupling point or element is shown and described, the other being the same. The intermediate coupling point or element 5, 6 of the boom 2, 3 moves, along the arc-shaped element 7, along a shaped guide 11 and its position is controlled by two cables 10, which are constrained to a trolley 21.

Each boom 2, 3 has a second guide 17 fixed to it that allows the respective intermediate coupling point or element 5, 6 to slide for a certain section also along the boom 2, 3 itself.

With regard to the arc-shaped element 7, it is connected to the hull of the boat A through pivoting of its opposite ends around the axis 20, a mechanism for controlling the angular position of the arc-shaped element 7 with respect to the hull of the boat A being provided. In the example described, such a control mechanism comprises gear wheels 22 that, through an electrical or mechanical actuation, for example a motor 14, allow the inclination of the arc-shaped element 7 to be modified until it is completely lowered onto the deck of the boat A.

FIG. 6 schematically shows an example embodiment of the kinematism of the means for adjusting the orientation of the sail 1 through which the position of the joint 4 of the booms 2, 3 arranged at the bow is modified. In the illustrated solution, the joint 4, through the action of the two cables 15 that are constrained to the sliding element 8, which, in practice, consists of a trolley to which the joint 4 itself is constrained, moves along an arched guide 9 that arches around the bow of the boat A.

By moving the sliding element 8, to which the joint 4 of the two booms 2, 3 is constrained, on the same side or on the opposite side with respect to the position of the two booms 2, 3, it is possible to keep the sail plan of the sail 1 in griping position (towards the centre of the hull) or in bearing up position (heeled outside of the hull).

The two cables 15 that control the position of the sliding element 8, which carries the joint 4, can also be the two ends of a single cable that, through a closed circuit and an electric motor 16, make the whole thing easy to control.

With the sail system according to the invention, the upper boom is raised towards the top of the arc-shaped element 7, whereas the second boom is in the lower part of the arc. During griping, the joint 4 of the two booms 2, 3, through the sliding element 8 to which it is constrained, follows the arched guide 9 on the leeward side and moves back until the sail 1 is raised into the desired position.

The movement of the sliding element 8, to which the joint 4 of the two booms 2, 3 is constrained, along the arched guide 9 allows the sail 1 to be "surged" or "hauled".

On the other hand, during bearing up, the joint 4, through the sliding element 8 to which it is constrained, follows the arched guide 9 on the windward side and moves back until the sail 1 is "heeled" as desired.

Turning and gybing in navigation take place through the movement, from one tack to the other, of the intermediate coupling points or elements 5, 6 of the booms 2, 3 along the arc-shaped element 7 that defines a bridge between the two tacks.

FIGS. 7-14 show a second embodiment of the sail system according to the present invention which, according to a characteristic feature of the present invention, comprises a sail 101 that is substantially isosceles triangle shaped and that is carried and controlled by two booms 102, 103 arranged along the substantially equal sides of the sail 101. The two booms 102, 103 are articulated together at the end facing the bow with a joint 104 that defines a vertex of the triangle or rather of the sail 101.

Each of the two booms 102, 103 has a respective coupling point or element 105, 106 to an arc-shaped element 107. The arc-shaped element 107 has the opposite ends pivoted around an axis 120 transverse to the hull of the boat A, so as to be able to be lowered onto the deck of the boat A or raised from it with a defined angle of inclination, with a control mechanism that is not depicted, but analogous to the one illustrated in relation to the first embodiment.

The coupling points or elements 105, 106 of the two booms 102, 103 to the arc-shaped element 107 are in a substantially middle position with respect to the length of the booms 102, 103 and are slidably mounted both along the arc-shaped element 107 and along a section of the respective boom 102, 103. Again according to a characteristic feature of the present invention, the sail 101, i.e. the sail system, is provided with a further coupling point or element to the boat A, on which coupling element means for adjusting the orientation of the sail 101 itself act.

In the embodiment represented in FIGS. 7-14 such a further coupling point or element is defined by a coupling body 130 that is slidably mounted along a tie rod 131 that, when the sail 101 is raised and open, is stretched between the two booms 102, 103, whereas the means for adjusting the orientation of the sail 101 comprise a sheet 132 coupled with the coupling body 130.

The sheet lead 133 of the sheet 132 is carried by a sliding body, of the trolley type, which slides along a further arc-shaped element 171 coupled with the deck of the boat A.

The joint 104 of the two booms 102, 103 consists of a cylindrical hinge with its axis perpendicular to the plane defined by the two booms 102, 103.

Unlike the first embodiment, the joint 104 is not constrained to the boat A.

The joint 104 allows for the two booms 102, 103 to be brought towards one another to close or remove lift from the sail 101 and for the two booms 102, 103 to be taken apart from one another to open and unfurl the sail 101.

The coupling points or elements 105, 106 of the two booms 102, 103 to the arc-shaped element 107 are associated with trolleys that slide along a guide 111 defined along the arc-shaped element 107 itself through a cable device analogous to the one illustrated in FIG. 4 and not represented in detail.

Each of the two booms 102, 103 is also equipped with a respective linear guide 117 along which the coupling points or elements 105, 106 are guided.

Such coupling points or elements 105, 106 are also equipped with suitable rotation joints that allow the maneuvers of the sail 101 to be performed.

Thanks to the sliding of the intermediate coupling points or elements 105, 106 of the two booms 102, 103 both along the arc-shaped element 107 and along a section of the booms themselves, it is possible both to perform the maneuvers on the sail 101 (hoisting, variation of lift, turning, gybing, dropping down) and to lower the two booms onto the deck or into the hull of the boat.

Thanks to the rotation of the arc-shaped element 107 around the axis 120, on the other hand, it is possible to lower it onto the deck, when it is not wished to use the sail system, and to adjust the vertical position of the sail 101, or rather of the sail centre of the sail 101, when the sail system is in use.

The maneuvers of taking the two booms 102, 103 towards one another and apart are assisted by a cable mechanism that allows both the sail 101 to be arranged open, so that the longitudinal axis B thereof is perpendicular to the plane defined by the arc-shaped element 107, and for the open sail 101 to be moved back with respect to the hull of the boat A.

Such a cable mechanism comprises two first fixed cables 140 of equal length, each of which has one end constrained to the mobile trolley along the respective boom 102, 103 and the opposite end constrained to a support 141 of blocks 142.

Each block 142 has a respective second cable 143 wound around it, said second cable 143 has one end fixed to the mobile trolley along the respective boom 102, 103 and the opposite end constrained to a fixed point of the respective boom 102, 103 near to the joint 104 and is transmitted around a further block associated with the respective trolley.

Thanks to such a cable mechanism, when the two booms 102, 103 are opened out, they move back with respect to the arc-shaped element 107 and become arranged so that the longitudinal axis B is perpendicular to the plane defined by the arc-shaped element 107.

This configuration allows the vertical position of the sail 101 to be modified by adjusting the angle of inclination of the arc-shaped element 107 with respect to the deck of the boat A, without the sail 101 interfering with the deck itself.

The tie rod 131 consists of a cable that passes around a pair of pulleys 144, which are associated with the ends of the two booms 102, 103 opposite the joint 104, and having the opposite ends constrained to the end of a respective elastic cable 145, the opposite end of which is constrained in a fixed point to the respective boom.

The coupling body 130 of the sheet 132 consists of a ring able to slide along the tie rod 131.

The sheet lead 133 is carried by a sliding body, of the trolley type, which slides along a further arc-shaped element 171 coupled with the deck of the boat A. Such a further arc-shaped element 171 advantageously consists of the roll-bar with which pleasure boats (yacht) are usually equipped.

The two booms 102, 103 are shaped with a profile such as to follow the profile of the hull of the boat A so as to be able to be accommodated, when the sail 101 is lowered, on the deck of the boat A or be housed in a suitable compartment 200 formed on a side of the hull of the boat A.

In the latter case, appendices for guiding the two booms 102, 103 extend from both the arc-shaped element 107 and the further arc-shaped element 171 and inside the compartment 200.

FIGS. 7 to 12 show in sequence the steps of lifting and opening the sail 101 from the lowered and closed configuration, in which the two booms 102, 103 are brought together and placed back inside the compartment 200 and the arc-shaped element 107 is lowered onto the deck of the boat A.

After having raised the arc-shaped element 107 on the deck and having arranged it parallel to the further arc-shaped element 171, the two booms 102, 103, through the sliding of their respective coupling points or elements 105, 106 along the arc-shaped element 107 aided by the parallel sliding of the sheet lead 133 along the further arc-shaped element (roll-bar) 171, are raised keeping them close to one another (FIGS. 9 and 10).

Thereafter, the intermediate coupling point or element of the lower boom, in this case the coupling point or element 106 of the boom 103, is made to slide downwards along the arc-shaped element 107 so as to open the sail 101.

During this step, thanks to the cable mechanism described above, the two booms 102, 103 move back with respect to the arc-shaped element 107 and are arranged so that the longitudinal axis B of the sail 101 is perpendicular to the plan defined by the arc-shaped element 107.

At the same time, the tie rod 131 is stretched between the two booms 102, 103.

FIGS. 13 and 14 show the sail 101 open in a different vertical position obtained by modifying the inclination of the arc-shaped element 107 with respect to the deck of the boat A.

FIGS. 15 and 16 schematically show the turning steps of the sail 101.

The intermediate coupling point of the lower boom, in this case the coupling point or element 106 of the boom 103, is made to slide along the arc-shaped element 107 so as to bring the two booms 102, 103 together and remove lift from the sail 101.

The two intermediate coupling points or elements 105, 106 of the two booms 102, 103 are made to slide simultaneously along the arc-shaped element 107 taking the closed sail 101 towards the opposite tack, as indicated by the arrow F in FIG. 15.

Thereafter, the intermediate coupling point or element of the lower boom, in this case the coupling point or element 105 of the boom 102, is made to slide downwards along the arc-shaped element 107 so as to open the sail 101. The sheet 132 allows the maneuvers to adjust the orientation of the sail 101 to be carried out, i.e. to "surge" and "haul" the sail 101, as can be easily understood by the man skilled in the art.

The first embodiment of the sail system according to the present invention is particularly suitable for commercial boats, for which the bulk of the arc-shaped guide 9 does not constitute a limitation.

The second embodiment of the sail system according to the present invention, on the other hand, is particularly suitable for pleasure boats (yacht).

As can be observed from the earlier description, the sail system according to the present invention, once lowered, disappears completely, without leaving any element in view on the hull (masts, shrouds, etc.).

In this way the sail system is suitable to be used also in motor boats.

Moreover, the sail system described is extremely easy to control even by inexperienced users.

The present invention has been described for illustrating but not limiting purposes, according to its preferred embodiments, but it should be understood that variations and/or modifications can be brought by men skilled in the art without for this reason departing from the relative scope of protection, as defined by the attached claims. For example, the bow point can move along different shaped guides (for example Y-shaped) with respect to the arc-shaped one shown.

The invention claimed is:

1. A sail system comprising a substantially isosceles-triangle-shaped sail, two booms, arranged along substantially equal sides of the sail and articulated to one another at an end with a joint that defines a vertex of said triangle-shaped sail, and an arc-shaped element, which can be coupled to a deck of a boat on which said sail system is provided, with two ends pivoted around an axis transverse to a hull of the boat, said arc-shaped element being mobile around said axis between a configuration raised from the deck and a configuration lowered onto the deck, wherein each boom has a coupling element on said arc-shaped element, said coupling element being slidably mounted both along said arc-shaped element and along a section of the respective boom, and wherein said sail is provided with a further coupling element to said boat on which means for adjusting the orientation of the sail itself act, said booms being lowerable onto a side of the boat and said arc-shaped element being lowerable onto the deck of the boat.

2. The sail system according to claim 1, wherein said further coupling element coincides with said joint and in that said means for adjusting the orientation of the sail comprise a sliding element to which said joint is constrained and that is mobile along a guide intended to be arranged bow of said boat.

3. The sail system according to claim 1, wherein said further coupling element is defined by a coupling body that is slidably mounted along a tie rod that, when said sail is raised and open, is stretched between said two booms, and in that said means for adjusting the orientation of the sail comprise a sheet coupled with said coupling body.

4. The sail system according to claim 3, wherein the sheet lead of said sheet is carried by a support body that is slidably mounted along a further arc-shaped element able to be coupled with said deck.

5. The sail system according to claim 1, wherein said booms are shaped with a profile corresponding to the lateral profile of the hull of the boat on which said sail system is intended to be mounted.

6. A boat comprising a sail system according to claim 1, wherein the boat comprises a seat defined on one side of the deck for housing the booms lowered onto the deck itself or into a compartment located on at least one side of the hull for accommodating said booms lowered onto the side of said boat.

* * * * *